US005263604A

United States Patent [19]

Metz

[11] Patent Number: 5,263,604

[45] Date of Patent: Nov. 23, 1993

[54] SUSPENSION ARRANGEMENT FOR A TANK

[75] Inventor: Herbert Metz, Feldkirchen/Westerham, Fed. Rep. of Germany

[73] Assignee: Messerschmitt-Bölkow-Blohm AG, Fed. Rep. of Germany

[21] Appl. No.: 906,297

[22] Filed: Jul. 1, 1992

[30] Foreign Application Priority Data

Jul. 1, 1991 [DE] Fed. Rep. of Germany ..... 4121762

[51] Int. Cl.[5] ..... F17C 7/02

[52] U.S. Cl. ..... 220/445; 220/653; 220/421

[58] Field of Search ..... 220/420, 421, 422, 425, 220/469, 445, 901, 651, 652, 653, 654

[56] References Cited

U.S. PATENT DOCUMENTS

| | | | |
|---|---|---|---|
| 1,005,933 | 10/1911 | Brown | 220/654 |
| 1,416,849 | 5/1922 | Loop | 220/653 |
| 2,800,249 | 7/1957 | Beckwith | 220/901 |
| 2,863,297 | 12/1958 | Johnston | 220/445 |
| 3,207,353 | 9/1965 | Canty et al. | 220/901 |
| 3,272,375 | 9/1966 | Holcombe . | |
| 3,782,128 | 1/1974 | Hampton et al. | 220/901 |
| 4,231,481 | 11/1980 | Nash et al. | 220/445 |
| 4,246,696 | 1/1981 | Bauer et al. | 174/179 |
| 4,300,354 | 11/1981 | Bucks et al. | 220/445 |
| 4,992,313 | 2/1991 | Shobert et al. | 87/1 |

FOREIGN PATENT DOCUMENTS

| | | | |
|---|---|---|---|
| 543151 | 9/1959 | Belgium | 220/653 |

*Primary Examiner*—Allan N. Shoap
*Assistant Examiner*—S. Castellano
*Attorney, Agent, or Firm*—Evenson, McKeown, Edwards & Lenahan

[57] ABSTRACT

A suspension arrangement for a thermally insulated tank surrounded by a casing structure. Inside, the tank has a central part from which struts extend away in a star-shape through the exterior tank wall to the casing structure and are connected with the latter. Inside the tank, the struts are guided in gastight connecting tubes which connect the central part with the exterior tank wall.

6 Claims, 2 Drawing Sheets

SUSPENSION ARRANGEMENT FOR A TANK

BACKGROUND AND SUMMARY OF THE INVENTION

This invention relates to a suspension arrangement for a thermally insulated tank.

A suspension arrangement of this generic type is disclosed in European Patent Document EP 0 014 250 A1. There, the supporting parts are made of holding straps consisting of several individual elements which are connected behind one another and with one another and are made of various fiber materials of different thermal conduction coefficients and different thermal expansion coefficients. The element closest to the tank is made of fiber material with the comparatively lowest thermal expansion coefficient and the comparatively highest thermal conduction coefficient. Despite the division into individual elements of different fiber materials, a construction requiring rather high expenditures, the path for the heat insulation, in the case of low-temperature tanks, is relatively short so that the holding straps still introduce high amounts of heat into the tank. For this reason, individual elements are also thermally shielded with respect to one another by means of cooled insulating layers. Larger temperature differences between the tank shell and the casing structure, in the case of low-temperature tanks, cause a shrinking of the tank shell and a high tensile strain on the fastening parts. In the case of long tanks, the radial shrinking is small relative to the longitudinal shrinking so that length compensation by placing the holding straps in a inclined position is no longer possible.

German Patent Document DE 29 42 164 A1 discloses a wall support for double-walled vessels, specifically Dewar-vessels. These are adjustable supports between the two tank walls for better adjustment and mounting of the double-walled vessel; thus both tank walls are not connected with one another.

It is an object of the invention to develop a suspension arrangement of the above-mentioned type in such a manner that a largely tension-free suspension of the tank is achieved in the casing structure, and at the same time, the heat exchange from the casing structure into the tank and vice versa as a result of the fastening parts is minor.

This object is achieved according to the invention by means of the struts connected with the central part, which together with the tubes between the central part and the tank shell, provide an ideal stiffening of the shell structure as well as of the tank. Thus, in the case of this construction, a thermal shrinking (in the case of low-temperature tanks) or a thermal expansion (in the case of high-temperature tanks) of the tank has no influence on the prestressing of the tank suspension elements. The struts, which extend from the casing structure to the central part, form a long thermal bridge which transports only low quantities of heat from the casing structure to the tank. The loss of tank volume caused by the interior structure amounts only to approximately 1 percent.

In the case of low requirements for torsional rigidity, the central part can be arranged in the tank center, and the struts extend in a star-shape to the casing structure. To improve torsional rigidity, in another embodiment, the central part has a tube centerpiece, four struts respectively extending away from the ends of the tube centerpiece in a star-shape, to the casing structure. The struts may be made of a fiber-reinforced plastic material, for example. This material which, depending on the load, is either fiber-glass-reinforced or carbon-reinforced plastic material, has the advantage of a low heat expansion and a high stability under load. The space between the tubes connecting the central part with the exterior tank wall and the struts may be filled by a thermal insulating material so as to prevent the transmission of cold or heat from the tank toward the outside by way of the struts. Finally, it is possible, in the case of high requirements for torsional rigidity of the whole construction, to arrange tangential struts between the exterior tank wall and the casing structure, tangentially with respect to the exterior tank wall. Because of the relatively low load by which these struts are stressed, their wall thickness may be small. This also considerably reduces the possible heat conduction into the tank.

Other objects, advantages and novel features of the present invention will become apparent from the following detailed description of the invention when considered in conjunction with the accompanying drawings.

BRIEF DESCRIPTION OF THE DRAWINGS

FIG. 1 is a view of a first embodiment of a suspension arrangement for a tank according to;

DETAILED DESCRIPTION OF THE DRAWINGS

Figure 1:
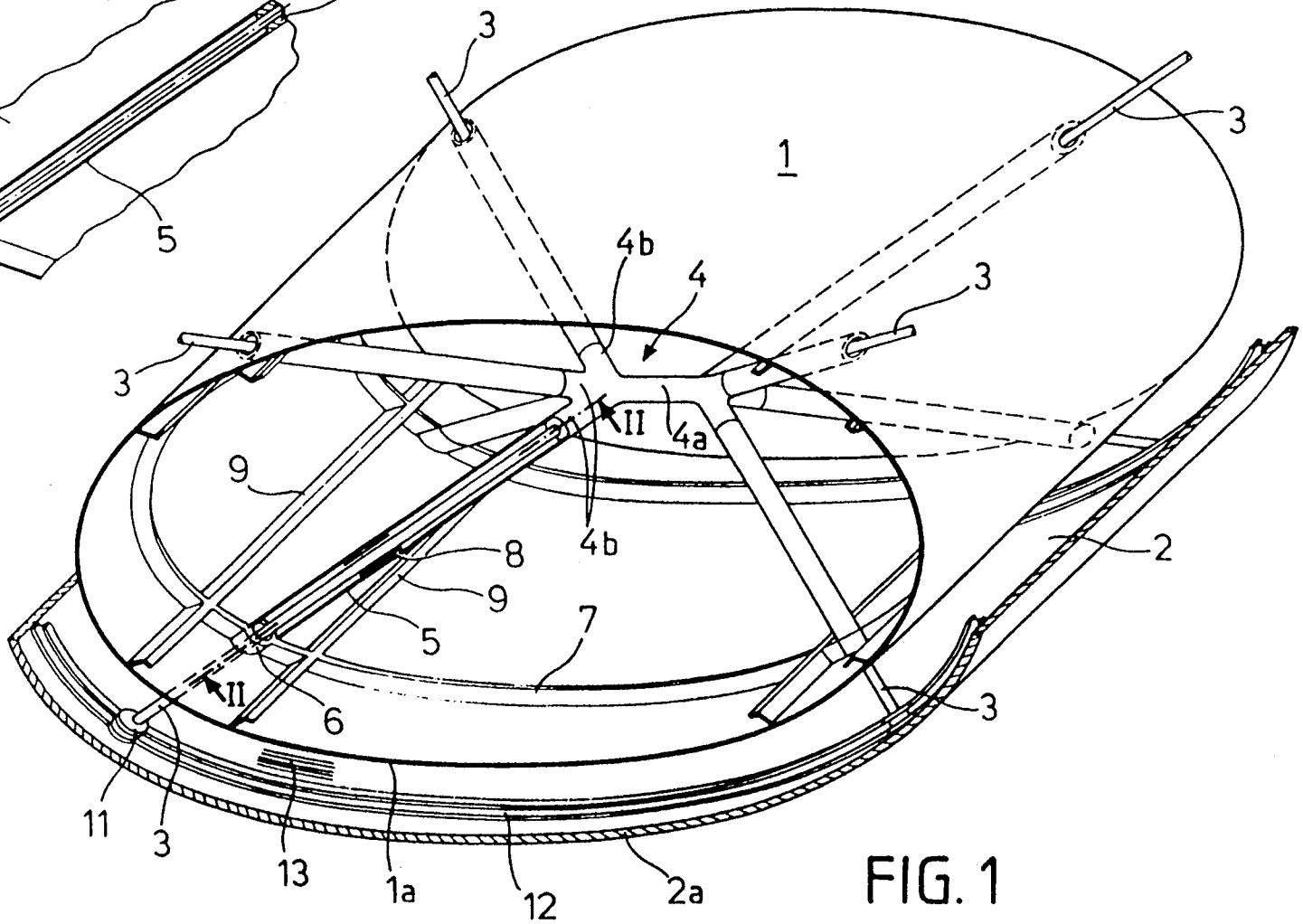
Figure 2:
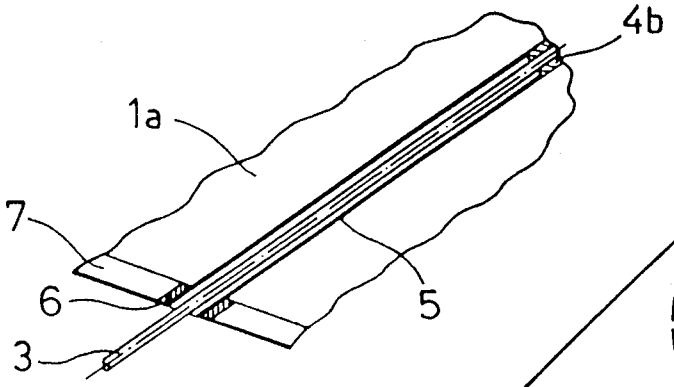
FIG. 2 is a sectional view II—II of FIG. 1.

Referring to FIG. 1, a tank 1 is fastened in a casing-shaped body structure 2 by means of eight struts 3. The struts 3 penetrate the tank 1 and run together in the center of the tank in a central part 4. The latter has a tube centerpiece 4*a*. Four tube end pieces extend away from each of the respective ends of this tube center piece 4, and accommodate the struts 3. The tube end pieces 4*b* are connected with connecting tubes 5 which end at the tank wall 1*a* in connecting sleeves 6 and in which the struts 3 are guided. All four connecting sleeves 6 of each side are embedded in frame profiles 7 reinforcing the tank wall 1*a*. The interior of the connecting tubes 5 is sealed off in a gastight manner with respect to the interior of the tank 1 and is filled with a thermal insulating material 8. Several longitudinal struts 9 arranged on the tank wall 1*a* are used for the further reinforcement of the tank 1. In the shell 2*a* of the body, the struts 3 are fastened in sockets 11 which are embedded in frame profiles 12 of the body structure 2. Between the body structure 2 and the tank 1, a thermal insulating material 13 may also be inserted. The struts 3 are preferably made of a fiber-reinforced material, and the connecting tubes 5 are made of aluminum.

Figure 3:
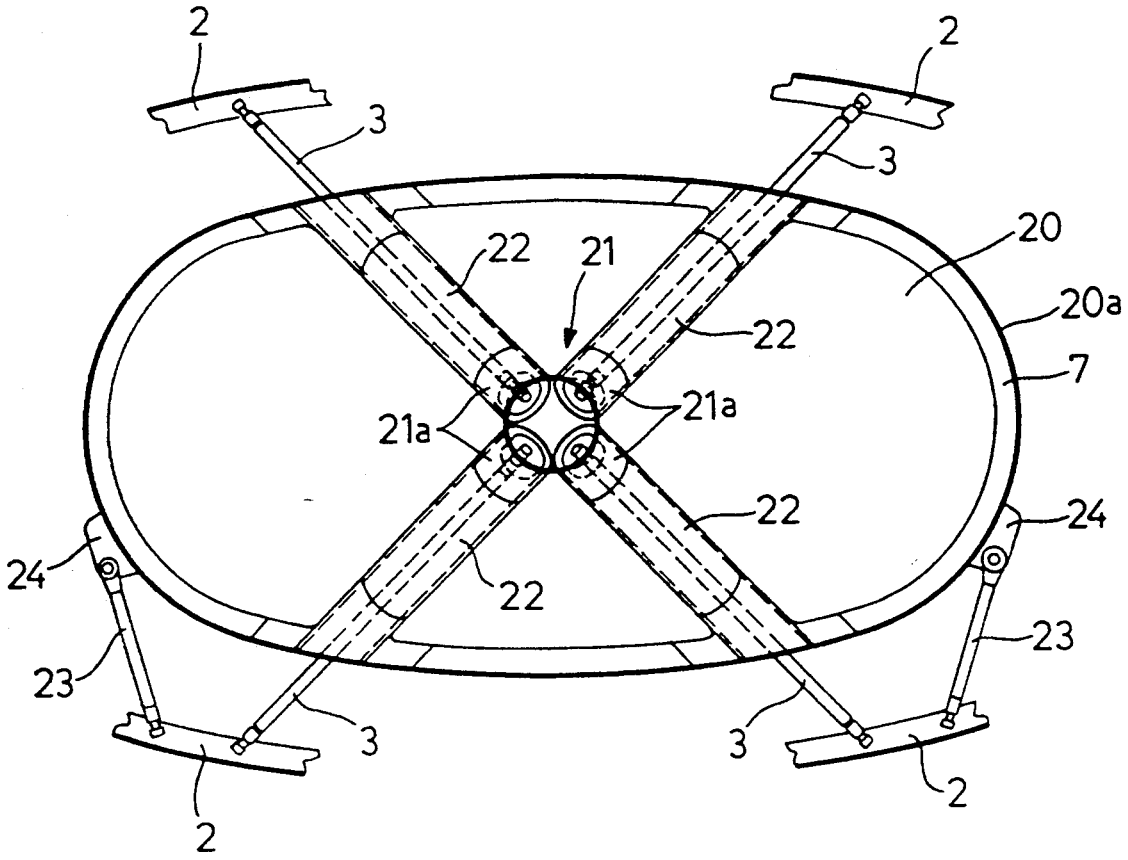
FIG. 3 is a view of a second embodiment of the suspension arrangement for the tank.

In the second embodiment of the suspension arrangement shown in FIG. 3, a tank 20 is fastened to the body structure 2 by means of eight struts 3. In this case, a central part 21 is situated directly in the tank center and consists of eight tube end pieces 21*a* which are connected with corresponding connecting tubes 22. The fastening of the tube end pieces in a profile 7 and of the struts on the body structure 2 may be constructed in the same manner as the embodiment of FIG. 1. To improve the torsional rigidity of the structure, two additional tangential struts 23 are fastened between the body structure 2 and sheet metal holders 24 connected with the profile 7.

Although the invention has been described and illustrated in detail, it is to be clearly understood that the same is by way of illustration and example, and is not to be taken by way of limitation. The spirit and scope of the present invention are to be limited only by the terms of the appended claims.

I claim:

1. A suspension arrangement for a tank having an interior wall and an exterior shell, both of which share a common longitudinal axis, said suspension arrangement comprising:

a plurality of gastight connecting tubes arranged inside said tank, a first end of each of said connecting tubes being connected with said interior wall, and respective second ends of said connecting tubes converging radially and longitudinally with respect to the common longitudinal axis to form a central part at a central area of said tank; and a plurality of struts arranged inside said connecting tubes, said struts being fastened to said central part at a first end thereof, and extending through said interior wall and being connected with said exterior shell at a second end thereof;

said struts extending outward, diverging radially and longitudinally with respect to the common longitudinal axis, away from said central part, to said exterior shell.

2. A suspension arrangement according to claim 1, wherein the struts are made of a fiber-reinforced plastic material.

3. A suspension arrangement according to claim 1, wherein the central part has a centerpiece in the form of a tube on which tube end pieces are mounted on each end, the struts extending angularly outward from the tube end pieces, to the exterior shell.

4. A suspension arrangement according to claim 3, wherein the struts are made of a fiber-reinforced plastic material.

5. A suspension arrangement according to claim 1, wherein the space between the connecting tubes and the struts is filled with thermal insulating material.

6. A suspension arrangement according to claim 3, wherein the space between the connecting tubes and the struts is filled with thermal insulating material.

* * * * *